US006551174B1

(12) United States Patent
Brown et al.

(10) Patent No.: US 6,551,174 B1
(45) Date of Patent: Apr. 22, 2003

(54) SUPPLYING SLURRY TO A POLISHING PAD IN A CHEMICAL MECHANICAL POLISHING SYSTEM

(75) Inventors: Kyle Brown, Sunnyvale, CA (US); Brian J. Brown, Palo Alto, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/160,392

(22) Filed: Sep. 25, 1998

(51) Int. Cl.[7] ..... B24B 57/02

(52) U.S. Cl. ..... 451/41; 451/60; 451/288; 137/876

(58) Field of Search ..... 451/60, 446, 287, 451/288, 41; 137/876

(56) References Cited

U.S. PATENT DOCUMENTS

| | | | | |
|---|---|---|---|---|
| 3,505,766 A | * | 4/1970 | Boettcher et al. | 451/288 X |
| 4,593,716 A | | 6/1986 | Cesna | 137/561 |
| 5,407,526 A | | 4/1995 | Danielson et al. | 156/636 |
| 5,478,435 A | | 12/1995 | Murphy et al. | 156/636.1 |
| 5,490,809 A | * | 2/1996 | Jones et al. | 451/60 |
| 5,664,990 A | * | 9/1997 | Adams et al. | 451/41 X |
| 5,709,593 A | * | 1/1998 | Guthrie et al. | 451/446 X |
| 5,750,440 A | | 5/1998 | Vanell et al. | 438/692 |
| 5,897,426 A | * | 4/1999 | Somekh | 451/57 X |

FOREIGN PATENT DOCUMENTS

| | | |
|---|---|---|
| DE | 1096794 | 1/1961 |
| EP | 0 709 166 A1 | 5/1996 |
| JP | 9029637 | 2/1997 |

* cited by examiner

*Primary Examiner*—David A. Scherbel
*Assistant Examiner*—Anthony Ojini
(74) *Attorney, Agent, or Firm*—Fish & Richardson

(57) ABSTRACT

An apparatus for supplying a slurry to a polishing surface has a slurry source, a slurry supply line, and a slurry return line. The slurry supply line and slurry return line are configured so that slurry may be directed from the outlet of the slurry supply line onto the polishing surface during a chemical mechanical polishing operation, or into an inlet of the slurry return line after the polishing operation is stopped. This permits continuous circulation of slurry through the slurry supply line to prevent coagulation.

34 Claims, 4 Drawing Sheets

SUPPLYING SLURRY TO A POLISHING PAD IN A CHEMICAL MECHANICAL POLISHING SYSTEM

BACKGROUND

The present invention relates generally to chemical mechanical polishing of substrates, and more particularly to an apparatus and method for supplying slurry to a polishing pad.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e, the exposed surface of the substrate, becomes increasingly non-planar. This non-planar surface presents a photolithography problem for the integrated circuit manufacturer. Therefore, there is a need to periodically planarize the substrate surface to provide a flat surface.

Chemical mechanical polishing (CMP) is one accepted method of planarization. This planarization method typically requires that the substrate be mounted on a carrier or polishing head. The exposed surface of the substrate is placed against a moving polishing pad. The polishing pad may be either a "standard" pad or a fixed-abrasive pad. A standard pad has a durable roughened surface, whereas a fixed-abrasive pad has abrasive particles held in a containment media. The carrier head provides a controllable load, i.e., pressure, on the substrate to push it against the polishing pad. A polishing slurry, including at least one chemically-reactive agent, and abrasive particles, if a standard pad is used, is supplied to the surface of the polishing pad.

An effective CMP process not only provides a high polishing rate, but also provides a substrate surface which is finished (lacks small-scale roughness) and flat (lacks large-scale topography). The polishing rate, finish and flatness are determined by the pad and slurry combination, the relative speed between t.-ie substrate and pad, and the force pressing the substrate against the pad.

One problem in CMP is coagulation of the polishing slurry. Specifically, small abrasive particles in the slurry tend to conglomerate to form larger particulates. These large particulates create scratches, e.g., shallow grooves on the order of 300 angstroms (A) deep, in the substrate surface. These scratches render the substrate finish unsuitable for integrated circuit fabrication, decreasing process yield.

SUMMARY

In one aspect, the invention is directed to an apparatus for supplying a slurry to a polishing surface. The apparatus has a slurry source, a slurry supply line, and a slurry return line. The slurry supply line extends from the slurry source and has an outlet that may be fluidly coupled to a dispensing port positionable over the polishing surface to deliver slurry thereto during a chemical mechanical polishing operation. The slurry return line extends between the dispensing port and the slurry source, and has an inlet that may be fluidly coupled to the outlet of the slurry supply line to direct slurry away from the dispensing port and to the slurry supply.

In another aspect, the slurry supply line extends from the slurry source and has an outlet located at or proximate to a slurry dispensing point. The slurry return line extends from the slurry source and has an inlet. The slurry supply line and slurry return line are configured so that slurry may be directed from the outlet of the slurry supply line onto the polishing surface during a chemical mechanical polishing operation, and from the outlet of the slurry supply line into the inlet of the slurry return line after the polishing operation is stopped to return slurry to the slurry supply. This substantially eliminates deadleg from the slurry supply line.

Implementations of the invention may include the following. A pump may provide a flow of slurry through the slurry supply line, e.g., during the polishing operation. The pump may also direct slurry through the slurry supply line and the slurry return line, e.g., after the polishing operation is stopped. Thus, the pump may operate to provide a substantially continuous flow of slurry through the slurry supply line. A filter may be located between the slurry source and the pump.

A valve, e.g., a ball valve or a plunger valve, at the outlet of the slurry supply line may be operable between a first position in which the outlet of the slurry supply line is fluidly coupled to the port to dispense slurry onto the polishing pad and a second position in which the outlet of the slurry supply line is fluidly coupled to the inlet of the slurry return line. A portion of the slurry supply line may be flexible and moveable between a first position in which the outlet of the slurry supply line dispenses slurry to the polishing surface and a second position in which the slurry supply line is fluidly coupled to the supply return line.

The inlet of the slurry return line may be located adjacent to the polishing surface to receive slurry from the slurry supply line. The outlet of the slurry supply line may be movable between a first position in which it is positioned over the polishing surface and a second position in which it positioned over the inlet of the slurry return line.

An arm may extend over the polishing surface and support at least a portion of the slurry supply line. The outlet of the slurry supply line may be located at the end of the arm. The slurry supply line can be a passage in the arm or tubing supported by the arm. A machine base may support the polishing surface, and the arm may be pivotally connected to the base.

A second slurry supply line may extend from the slurry source and have a second outlet proximate to a second slurry dispensing point. A second slurry return line may extend from the slurry source and have an inlet. The second slurry supply line and second slurry return line may be configured so that slurry may be directed from the outlet of the slurry supply line to a second polishing surface during a chemical mechanical polishing operation, and into the inlet of the slurry return line after the polishing operation is stopped to return slurry to the slurry supply. This substantially eliminates deadleg from the second slurry supply line.

In another aspect, the invention is directed to a method of chemical mechanical polishing. In the method, slurry is pumped from a slurry source to an outlet of a slurry supply line that is positionable over a polishing surface. The slurry is directed from the outlet to the polishing surface. The outlet of the slurry supply line is fluidly coupled to an inlet of a slurry return line after the polishing operation has stopped to return the slurry to the slurry source.

Implementations of the invention may include the following. The pumping may create a flow of slurry through the slurry supply line and the slurry return line after polishing operation has stopped. The pumping may create a substantially continuous flow of slurry through the slurry supply line.

Advantages of the invention may include the following. Coagulation of slurry is reduced or eliminated, thereby reducing scratch defects and increasing process yield.

Other features and advantages will be apparent from the following description, including the drawings and claims.

DETAILED DESCRIPTION

Figure 1:
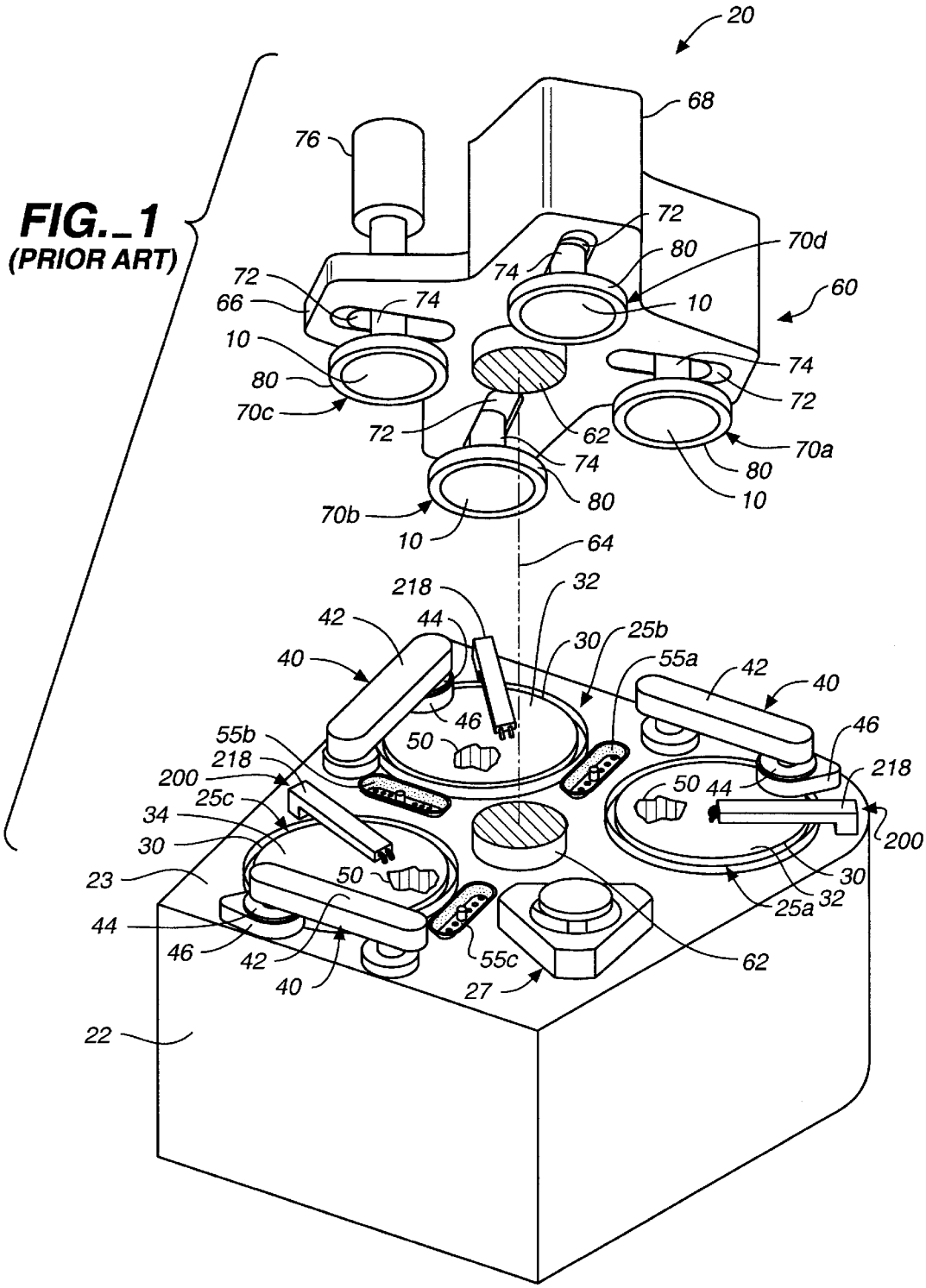
FIG. 1 (PRIOR ART)
FIG. 1 is a schematic exploded perspective view of a chemical mechanical polishing apparatus.

Referring to FIG. 1, one or more substrates 10 will be polished by a chemical mechanical polishing apparatus 20. A description of polishing apparatus 20 may be found in U.S. Pat. No. 5,738,574, the entire disclosure of which is incorporated herein by reference. Polishing apparatus 20 includes a lower machine base 22 with a table top 23 mounted thereon and a removable outer cover (not shown). Table top 23 supports a series of polishing stations, including a first polishing station 25*a*, a second polishing station 25*b*, a final polishing station 25*c*, and a transfer station 27. Transfer station 27 forms a generally square arrangement with the three polishing stations 25*a*, 25*b* and 25*c*. Transfer station 27 serves multiple functions, including receiving individual substrates 10 from a loading apparatus (not shown), washing the substrates, loading the substrates into carrier heads, receiving the substrates from the carrier heads, washing the substrates again, and finally, transferring the substrates back to the loading apparatus.

Each polishing station includes a rotatable platen 30 on which is placed a polishing pad. The first and second stations 25*a* and 25*b* may include a relatively hard polishing pad 32, whereas the final polishing station may include a relative soft polishing pad 34. If substrate 10 is an "eight-inch" (200 millimeter) or "twelve-inch" (300 millimeter) diameter disk, then the platens and polishing pads will be about twenty inches or thirty inches in diameter, respectively. Each platen 30 may be a rotatable aluminum or stainless steel plate connected to a platen drive motor (not shown). For most polishing processes, the platen drive motor rotates platen 30 at thirty to two hundred revolutions per minute, although lower or higher rotational speeds may be used.

Each polishing station 25*a*–25*c* may further include an associated pad conditioner apparatus 40. Each pad conditioner apparatus 40 has a rotatable arm 42 holding an independently-rotating conditioner head 44 and an associated washing basin 46. The pad conditioner apparatus 40 maintains the condition of the polishing pad so that it will effectively polish substrates.

At each polishing station, a polishing slurry 50 containing deionized water, abrasive particles (e.g., silica particles for oxide polishing) and a chemically reactive component (e.g., potassium hydroxide for oxide polishing) is supplied to the polishing pad surface by a slurry delivery system 200. As described in greater detail below, the slurry delivery system is designed to prevent coagulation of the slurry.

Two or more intermediate washing stations 55*a* and 55*b* may be positioned between neighboring polishing stations. The washing stations rinse the substrates as they pass from one polishing station to another.

A rotatable multi-head carousel 60 is positioned above lower machine base 22. Carousel 60 is supported by a center post 62 and is rotated thereon about a carousel axis 64 by a carousel motor assembly located within machine base 22. Center post 62 supports a carousel support plate 66 and a cover 68. Carousel 60 includes four carrier head systems 70*a*, 70*b*, 70*c*, and 70*d*. Three of the carrier head systems receive and hold substrates, and polish them by pressing them against the polishing pads on the platens of the polishing stations. One of the carrier head systems receives a substrate from and delivers a substrate to transfer station 27.

The four carrier head systems 70*a*–70*d* are mounted on carousel support plate 66 at equal angular intervals about carousel axis 64. Center post 62 allows the carousel motor to rotate carousel support plate 66 and to orbit carrier head systems 70*a*–70*d* and the attached substrates thereto about carousel axis 64.

Each carrier head system 70*a*–70*d* includes a carrier or carrier head 80. A carrier drive shaft 74 connects a carrier head rotation motor 76 (shown by the removal of one quarter of cover 68) to carrier head 80 so that each carrier head 80 can independently rotate about its own axis. There is one carrier drive shaft and motor for each head. In addition, each carrier head 80 independently laterally oscillates in a radial slot 72 formed in carousel support plate 66. A slider (not shown) supports each drive shaft in its associated radial slot. A radial drive motor (not shown) may move the slider to laterally oscillate the carrier head.

The carrier head 80 performs several mechanical functions. Generally, the carrier head holds the substrate against the polishing pad, evenly distributes a downward pressure across the back surface of the substrate, transfers torque from the drive shaft to the substrate, and ensures that the substrate does not slip out from beneath the carrier head during polishing operations.

The carrier head 80 may include a flexible membrane (not shown) which provides a substrate receiving surface. A description of a suitable carrier head 80 may be found in U.S. patent application Ser. No. 08/745,679, entitled a CARRIER HEAD WITH a FLEXIBLE MEMBRANE FOR a CHEMICAL MECHANICAL POLISHING SYSTEM, filed Nov. 8, 1996, by Steven M. Zuniga et al., assigned to the assignee of the present invention, the entire disclosure of which is incorporated herein by reference.

Figure 2:
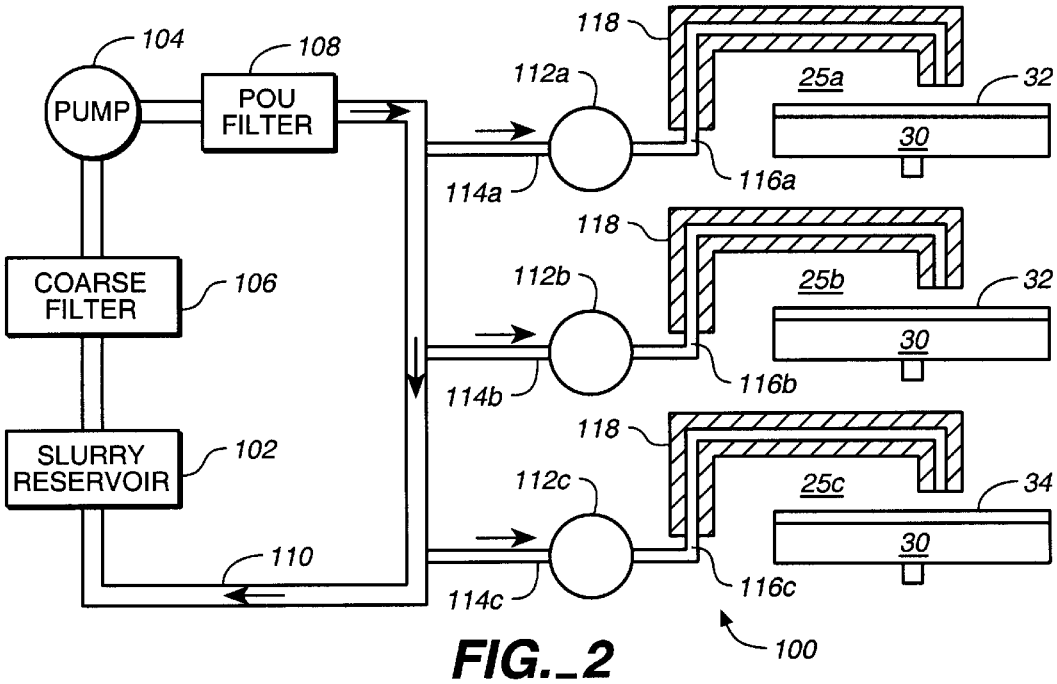
FIG. 2 (PRIOR ART)
FIG. 2 is a schematic diagram of a prior art slurry delivery system.

In order to more clearly explain the invention, a conventional slurry delivery system will first be described. Referring to FIG. 2, a conventional slurry delivery system 100 includes a slurry reservoir 102, a pump 104, a coarse filter 106 located upstream of pump 104, and a point-of-use (POU) filter 108 located downstream of pump 104. Slurry is pumped through filters 106 and 108 by pump 104, and returned to reservoir 102 through a slurry manifold 110. Pump 104 may be operated so that slurry from reservoir 102 is continuously circulated through the slurry line and the filters. The continuous motion of the slurry helps prevent coagulation, and filters 106 and 108 remove slurry particle conglomerates from slurry manifold 110.

A plurality of peristaltic pumps 112*a*, 112*b* and 112*c*, associated with polishing stations 25*a*, 25*b* and 25*c*, respectively, are fluidly coupled to slurry manifold 110 by intake lines 114*a*, 114*b* and 114*c*, respectively. Three supply lines 116*a*, 116*b* and 116*c* deliver slurry from peristaltic pumps 112*a*, 112*b* and 112*c*, respectively, to the polishing pads at the polishing stations. Each supply line extends through a combined slurry/rinse arm 118 that extends over platen 30. Although arm 118 is illustrated with only one supply line, the arm may include two or more supply lines to distribute multiple slurries to the surface of the polishing pad. The arm 118 also includes several spray nozzles (not shown) which provide a high pressure rinse of the polishing pad at the end of each polishing and conditioning cycle.

Unfortunately, the portion of the slurry delivery system extending between slurry manifold 110 and each polishing pad, e.g., intake line 114*a*, peristaltic pump 112*a* and supply line 116*a*, constitutes a so-called "deadleg". When slurry is not required at one of the polishing stations, e.g., polishing station 25*a*, the peristaltic pump associated with that polishing station is stopped, and the slurry in the deadleg sits stagnant and coagulates. When the peristaltic pump is restarted, coagulated slurry will be delivered to the polishing pad, where it can scratch the substrate and cause defects.

Figure 3A:
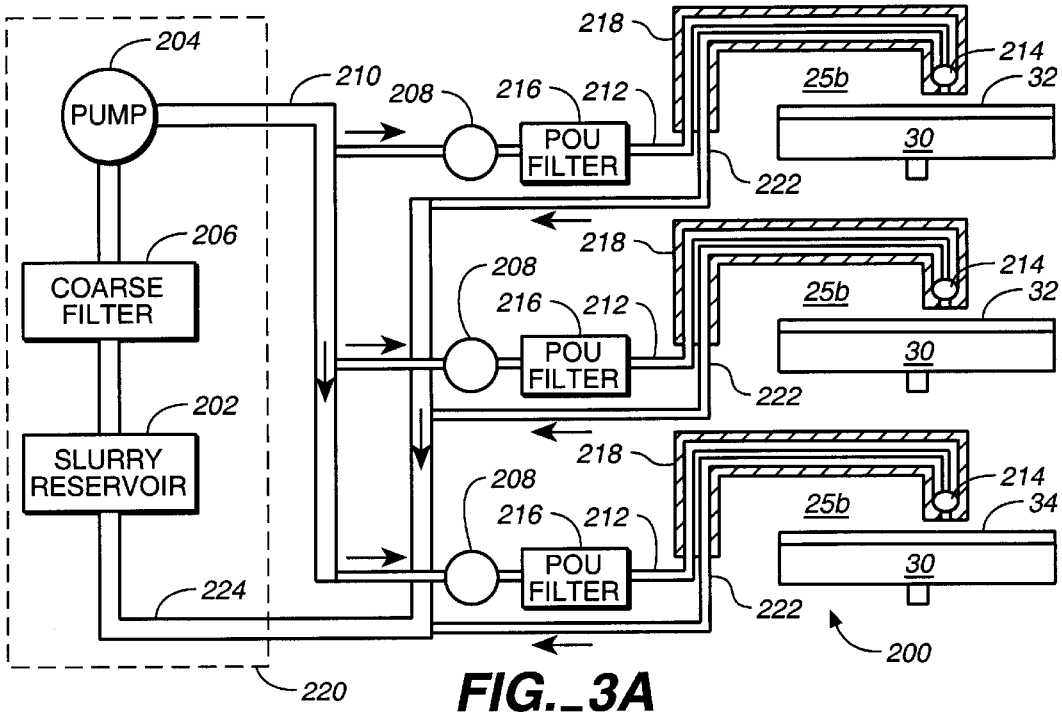
FIG. 3A is a schematic diagram of a slurry delivery system according to the present invention.
Figure 3B:
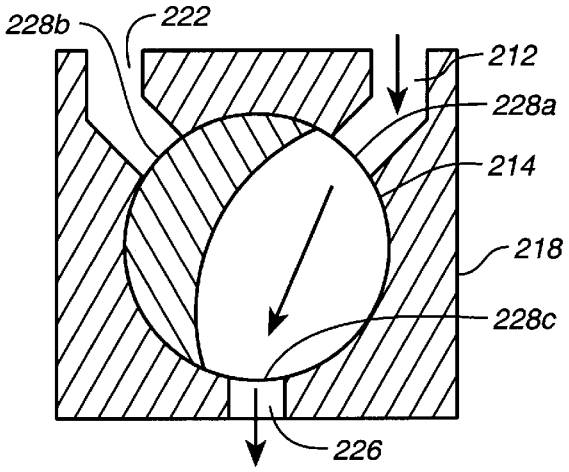
FIGS. 3B and 3C are enlarged views of a valve from the slurry delivery system of FIG. 3A.
Figure 3C:
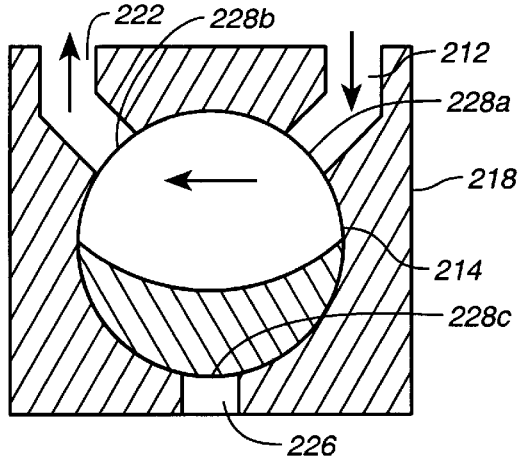

Referring to FIGS. 3A–3C, a slurry delivery system 200 is constructed without a deadleg. Slurry delivery system 200 includes a slurry reservoir 202, a primary pump 204, and a coarse filter 206 located between primary pump 204 and reservoir 202. Reservoir 202, primary pump 204 and coarse filter 206 may be located in machine base 22 or in a separate slurry supply module 220. Three peristaltic pumps 208 are connected to primary pump 204 by a slurry supply manifold 210. A slurry/rinse arm 218 extends over each polishing pad, and a three-way valve 214 is located at the end of the each arm. Each peristaltic pump 208 is fluidly coupled to a first port 228*a* of the three-way valve by a slurry supply line 212. A point-of-use filter 216 may be located in each slurry supply line 212 between the peristaltic pump and the three-way valve. A slurry return line 222 extends back through the arm to fluidly couple a second port 288*b* of each valve 214 to a slurry return manifold 224, which returns the slurry to reservoir 202. A third port 228*c* of valve 214 is connected to an exit port 226 (see FIGS. 3A and 3B) in the arm to dispense slurry onto the polishing pad.

In the configuration illustrated in FIGS. 3A–3C, valve 214 is a ball valve rotatable between a first position (shown in FIG. 3A) in which slurry supply line 212 is fluidly coupled to exit port 226, and a second position (shown in FIG. 3B) in which slurry supply line 212 is fluidly coupled to exit port 226. Thus, when the valve is in the first position, slurry is directed through slurry supply line 212 and exit port 226 and onto the polishing pad. In contrast, when the valve is in the second position, slurry is pumped out to the end of arm 218 via slurry supply line 212 and returned to reservoir 202 via slurry return line 222. Pumps 204 and 208 are operated to provide a substantially continuous, i.e., both during and between polishing operations (but not when slurry delivery system 200 is shut down for maintenance and the like), flow of slurry through the slurry supply line, thereby reducing coagulation and substrate defects.

The slurry supply line 212 may be a passageway formed integrally through arm 218, or it may be a flexible or rigid tube supported by the arm (either inside or outside the arm housing). Alternately, the slurry supply line may be sufficiently rigid that an arm is not required. Similarly, slurry return line 222 may be a passage formed through the arm, a flexible tube supported by the arm, or a rigid self-supporting tube.

Figure 4:
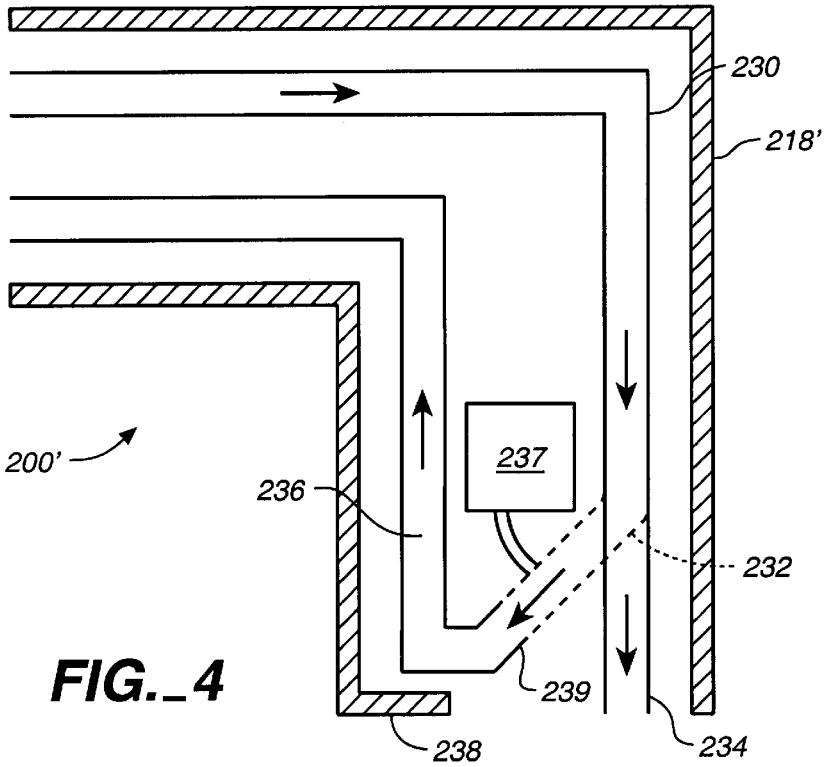
FIG. 4 is a schematic diagram of a slurry delivery system having a flexible slurry supply line.

FIG. 4 illustrates a slurry delivery system 200' in which the ball valve is replaced with a moveable tubing. For clarity, only the portion of the slurry delivery system associated with a single polishing station is illustrated. Additionally, the slurry reservoir, the coarse filter, the primary pump, the peristaltic pump and the point-of-use filter are not shown. A slurry/rinse arm 218' supports a slurry supply line 230 having an outlet 234 near the end of the arm. The slurry supply line 230 includes a flexible portion 232 located adjacent an aperture 238 in the arm 218'. The flexible portion of slurry supply line 230 is moveable between a first position in which the outlet of the slurry supply line dispenses slurry onto the polishing pad via outlet 234, and a second position (shown in phantom) in which the outlet of the slurry supply line is connected to an inlet 239 of a slurry return line 236. Inlet 239 may be provided with a seal (not shown) to prevent leakage of the slurry when the slurry supply line is connected to the slurry return line. Alternately, inlet 239 may be slightly wider than outlet 234. The flexible portion 232 of slurry supply line 230 may be actuated between the first and second positions by a pneumatic actuator 237. Between polishing operations at this particular polishing station, slurry supply line 230 is fluidly coupled to slurry return line 236 so that the pumps continuously recirculate slurry through the slurry delivery system. On the other hand, during polishing operations, flexible portion 232 is shifted so that slurry flows through outlet 234 and aperture 238 onto the polishing pad.

Figure 5:
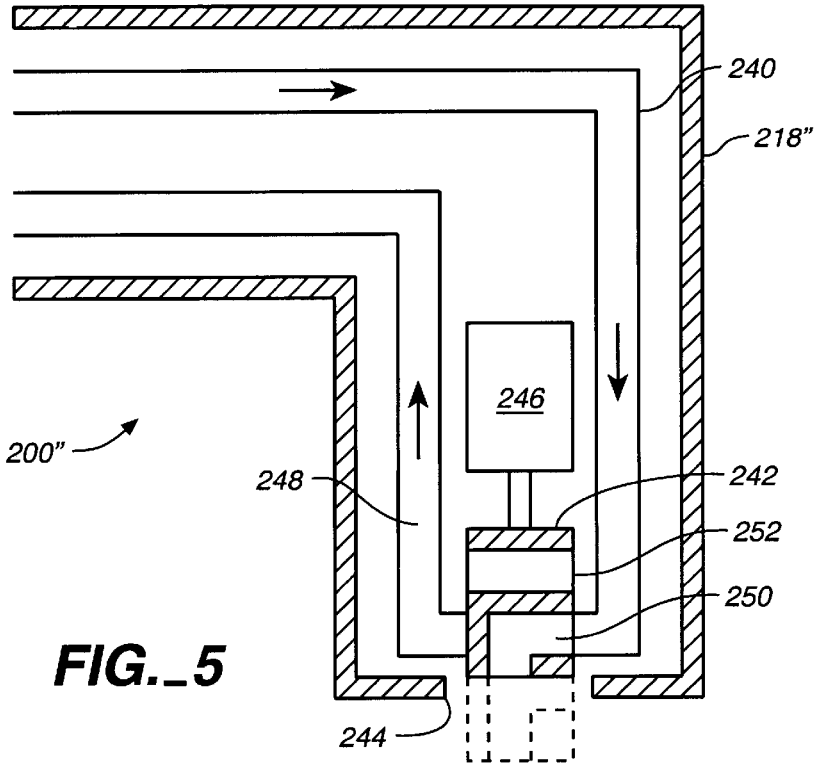
FIG. 5 is a schematic diagram of a slurry delivery system having a plunger valve.

Referring to FIG. 5, in another configuration, a slurry delivery system 200" includes a slurry supply line 240 to transport slurry to a plunger valve 242 located adjacent an aperture or port 244 at the end of a slurry/rinse arm 218". The plunger valve may be operated between a first position in which a first valve passage 250 directs slurry from slurry supply line 240 onto the polishing pad, and a second position (shown in phantom) in which a second valve passage 252 fluidly couples slurry supply line 240 to a slurry return line 248. Thus, during polishing at this particular polishing station, the plunger valve is in the first position to dispense slurry onto the pad. On the other hand, between polishing operations, the plunger valve is in the second position so that slurry is continuously circulated through the slurry delivery system. The plunger valve may be equipped with a lip-seal (not shown) to prevent leakage of the slurry from slurry supply line 240 and slurry return line 248. Plunger valve 242 may be actuated by a pneumatic actuator 246 in such a fashion as to minimize particle generation.

Figure 6:
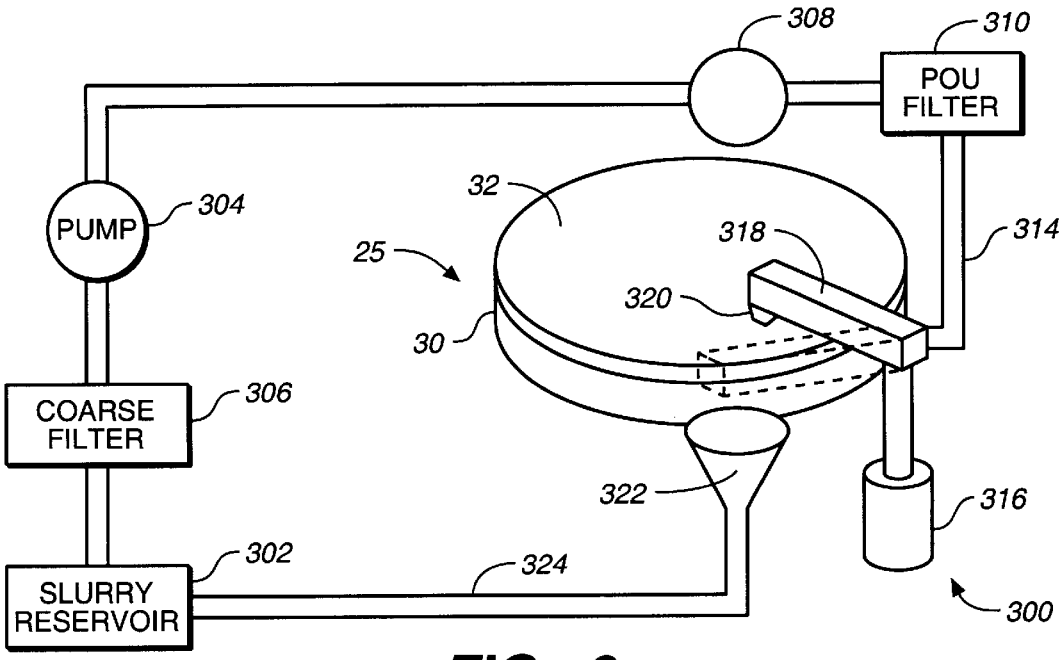
FIG. 6 is a schematic diagram of a slurry delivery system having a slurry catch inlet.

Referring to FIG. 6, in another embodiment (illustrated for a single polishing station 25), a slurry delivery system 300 includes a slurry reservoir 302, a primary pump 304, a coarse filter 306, a peristaltic pump 308 and a POU filter 310. Slurry delivery system 300 also includes a generally funnel-shaped slurry catch cup 322 located adjacent platen 30. The slurry catch cup 322 is fluidly coupled to reservoir 302 by a slurry return line 324. A slurry supply line 314 extends through a moveable slurry/rinse arm 318 to direct slurry onto polishing pad 32. The arm 318 is pivotally connected to table top 23 and may be moved between a first position in which an outlet 320 at the end of slurry supply line 314 is located over polishing pad 32, and a second position (illustrated in phantom) in which outlet 320 is positioned over slurry catch cup 322. A motor or pneumatic actuator 316 may be connected at the base of arm 318 to pivot the arm. Thus, during polishing, slurry delivery system 300 may position arm 318 over polishing pad 32, whereas between polishing operations, pneumatic actuator 316 may rotate or pivot arm 318 over slurry catch cup 322 so that slurry is continuously recirculated though slurry supply line 314 and slurry return line 324.

The invention is not limited to the embodiments depicted and described. Rather, the scope of the invention is defined by the appended claims.

What is claimed is:

1. An apparatus for supplying a slurry to a polishing surface, comprising:

a slurry source;

a slurry supply line extending from the slurry source and having an outlet that is selectively fluidly coupled to a dispensing port positionable over the polishing surface to deliver slurry thereto during a chemical mechanical polishing operation; and a slurry return line extending between the dispensing port and the slurry source, the slurry return line having an inlet that is selectively fluidly coupled to the outlet of the slurry supply line to direct slurry away from the dispensing port and to the slurry source.

2. The apparatus of claim 1, further comprising a pump to provide a flow of slurry through the slurry supply line during the polishing operation.

3. The apparatus of claim 2, wherein the pump provides a flow of slurry through the slurry supply line and the slurry return line after the polishing operation is stopped.

4. The apparatus of claim 3, wherein the pump operates to provide a substantially continuous uninterrupted flow of slurry through the slurry supply line both during and after the polishing operation.

5. The apparatus of claim 1, further comprising a valve at the outlet of the slurry supply line, the valve operable between a first position in which the outlet of the slurry supply line is fluidly coupled to the port to dispense slurry onto the polishing pad and a second position in which the outlet of the slurry supply line is fluidly coupled to the inlet of the slurry return line.

6. The apparatus of claim 5, wherein the valve is a ball valve rotatable between the first and second positions.

7. The apparatus of claim 1, wherein a portion of the slurry supply line is flexible and is moveable between a first position in which the outlet of the slurry supply line dispenses slurry to the polishing surface and a second position in which the slurry supply line is fluidly coupled to the slurry return line.

8. An apparatus for supplying a slurry to a polishing surface, comprising:

a slurry source;

a slurry supply line extending from the slurry source and having an outlet adjacent a slurry dispensing point; and a slurry return line extending from the slurry source and having an inlet, wherein the slurry supply line and slurry return line are configured so that slurry is selectively directed from the outlet of the slurry supply line onto the polishing surface during a chemical mechanical polishing operation, and is alternatively selectively directed from the outlet of the slurry supply line into the inlet of the slurry return line after the polishing operation is stopped to return slurry to the slurry supply and to provide a continuous uninterrupted flow of the slurry to substantially eliminate deadleg from the slurry supply line.

9. The apparatus of claim 8, further comprising an arm extending over the polishing surface and supporting at least a portion of the slurry supply line, the outlet of the slurry supply line being located at the end of the arm.

10. The apparatus of claim 9, wherein the slurry supply line comprises a passage in the arm.

11. The apparatus of claim 9, wherein the slurry supply line comprises tubing supported by the arm.

12. The apparatus of claim 9, further comprising a machine base to support the polishing surface, the arm being pivotally connected to the base.

13. The apparatus of claim 9, wherein the arm supports at least a portion of the slurry return line, the inlet of the slurry return line being located at the end of the arm adjacent the outlet of the slurry supply line.

14. The apparatus of claim 8, further comprising a valve at the outlet of the slurry supply line, the valve operable between a first position in which the outlet of the slurry supply line is fluidly coupled to a dispensing port to dispense slurry onto the polishing pad and a second position in which the outlet of the slurry supply line is fluidly coupled to the inlet of the slurry return line.

15. The apparatus of claim 8, wherein a portion of the slurry supply line is flexible and is operable between a first position in which the outlet of the slurry supply line dispenses slurry to the polishing surface and a second position in which the outlet of the slurry supply line is fluidly coupled to the inlet of the slurry return line.

16. The apparatus of claim 8, wherein the inlet of the slurry return line is located adjacent to the polishing surface to receive slurry from the slurry supply line.

17. The apparatus of claim 16, wherein the outlet of the slurry supply line is movable between a first position in which it is positioned over the polishing surface and a second position in which it positioned over the inlet of the slurry return line.

18. The apparatus of claim 8, further comprising a pump to direct slurry from the slurry source through the slurry supply line.

19. The apparatus of claim 18, wherein the pump operates to create a substantially continuous flow of slurry through the slurry supply line.

20. The apparatus of claim 8, further comprising a second slurry supply line extending from the slurry source and having a second outlet proximate to a second slurry dispensing point, and a second slurry return line extending from the slurry source and having an inlet, wherein the second slurry supply line and second slurry return line are configured so that slurry may be directed from the outlet of the slurry supply line to a second polishing surface during a chemical mechanical polishing operation, and wherein slurry may be directed from the outlet of the slurry supply line into the inlet of the slurry return line after the polishing operation is stopped to return slurry to the slurry supply and substantially eliminate deadleg from the second slurry supply line.

21. An apparatus for supplying a slurry to a polishing surface of a chemical mechanical polishing apparatus, comprising:

a slurry source;

a slurry delivery arm positionable over the polishing surface and having a dispensing port for dispensing slurry onto the polishing surface;

a slurry supply line extending from the slurry source to a valve located in the arm adjacent the dispensing port;

a slurry return line extending from the valve to the slurry source; and wherein the valve is operable between a first position in which the slurry supply line is fluidly coupled to the dispensing port and a second position in which the slurry supply line is fluidly coupled to the slurry return line for a continuous uninterrupted flow of the slurry.

22. The apparatus of claim 21, wherein the valve is a ball valve rotatable between the first and second positions.

23. An apparatus for supplying a slurry to a polishing surface of a chemical mechanical polishing apparatus, comprising:

a slurry source;

a slurry delivery arm positionable over the polishing surface and having a dispensing port for dispensing slurry;

a slurry supply line extending from the slurry source to the dispensing port;

a slurry inlet positioned adjacent the polishing surface;

a slurry return line extending from the slurry inlet to the slurry source; and wherein the slurry delivery arm is movable between a first position in which the dispensing port is positioned over the polishing surface and a second position in which the dispensing port is positioned off the polishing surface and over the slurry inlet to directs slurry into the slurry inlet.

24. A chemical mechanical polishing apparatus, comprising:

a rotatable polishing pad;

a carrier head for holding a substrate;

a slurry source;

a slurry supply line extending from the slurry source and having an outlet adjacent a slurry dispensing point; and a slurry return line extending from the slurry source and having an inlet, wherein the slurry supply line and slurry return line are configured so that slurry is selectively directed from the outlet of the slurry supply line onto the polishing pad during a chemical mechanical polishing operation, and is alternatively selectively directed from the outlet of the slurry supply line into the inlet of the slurry return line after the polishing operation is stopped to return slurry to the slurry supply and to provide a continuous uninterrupted flow of the slurry to substantially eliminate deadleg from the slurry supply line.

25. The apparatus of claim 24, wherein there are a plurality of polishing pads and a slurry supply line and a slurry return line associated with each polishing pad.

26. The apparatus of claim 25, further comprising a dispensing arm extending over each polishing pad, and a pump to direct slurry thereto.

27. The apparatus of claim 26, further comprising a carousel to position the carrier head over a selected one of the polishing pads.

28. A method of chemical mechanical polishing, comprising:

pumping slurry from a slurry source through a slurry supply line to an outlet of the slurry supply line;

selectively fluidly coupling the outlet to a dispensing port that is positionable over a polishing surface;

directing slurry from the outlet through the dispensing port to the polishing surface during a polishing operation; and selectively fluidly coupling the outlet of the slurry supply line to an inlet of a slurry return line that extends between the dispensing port and the slurry source after the polishing operation has stopped to return the slurry to the slurry source, thereby providing a continuous uninterrupted flow of the slurry.

29. The method of claim 28, wherein the pumping step creates a flow of slurry through the slurry supply line and the slurry return line after polishing operation has stopped.

30. The method of claim 28, wherein the pumping step creates a substantially continuous flow of slurry through the slurry supply line.

31. An apparatus for supplying a slurry to a polishing surface, comprising:

a slurry source;

a slurry supply line extending from the slurry source and having an outlet located at a slurry dispensing point; and a slurry return line extending from the slurry source and having an inlet, wherein the slurry supply line and slurry return line are configured so that slurry is selectively directed from the outlet of the slurry supply line onto the polishing surface during a chemical mechanical polishing operation, and is alternatively selectively directed from the outlet of the slurry supply line into the inlet of the slurry return line after the polishing operation is stopped to return slurry to the slurry supply and to provide a continuous uninterrupted flow of the slurry to substantially eliminate deadleg from the slurry supply line.

32. An apparatus for supplying a slurry to a polishing surface, comprising:

a slurry source;

a slurry supply line extending from the slurry source and having an outlet that is selectively fluidly coupled to a dispensing port positionable over the polishing surface to deliver slurry thereto during a chemical mechanical polishing operation;

a slurry return line extending between the dispensing port and the slurry source, the slurry return line having an inlet that is selectively fluidly coupled to the outlet of the slurry supply line to direct slurry away from the dispensing port and to the slurry source; and a valve at the outlet of the slurry supply line, the valve operable between a first position in which the outlet of the slurry supply line is fluidly coupled to the port to dispense slurry onto the polishing pad and a second position in which the outlet of the slurry supply line is fluidly coupled to the inlet of the slurry return line, wherein the valve is a plunger valve movable between the first and second positions.

33. An apparatus for supplying a slurry to a polishing surface, comprising:

a slurry source;

a slurry supply line extending from the slurry source and having an outlet adjacent a slurry dispensing point;

a pump to direct slurry from the slurry source through the slurry supply line;

a filter located between the slurry source and the pump; and a slurry return line extending from the slurry source and having an inlet, wherein the slurry supply line and slurry return line are configured so that slurry is selectively directed from the outlet of the slurry supply line onto the polishing surface during a chemical mechanical polishing operation, and is alternatively selectively directed from the outlet of the slurry supply line into the inlet of the slurry return line after the polishing operation is stopped to return slurry to the slurry supply and to provide a continuous uninterrupted flow of the slurry to substantially eliminate deadleg from the slurry supply line.

34. An apparatus for supplying a slurry to a polishing surface of a chemical mechanical polishing apparatus, comprising:

a slurry source;

a slurry delivery arm positionable over the polishing surface and having a dispensing port for dispensing slurry onto the polishing surface;

a slurry supply line extending from the slurry source to a valve located in the arm adjacent the dispensing port; and a slurry return line extending from the valve to the slurry source, wherein the valve is operable between a first position in which the slurry supply line is fluidly coupled to the dispensing port and a second position in which the slurry supply line is fluidly coupled to the slurry return line for a continuous uninterrupted flow of the slurry, and wherein the valve is a plunger valve movable between the first and second positions.

* * * * *